US012680176B2

(12) United States Patent
Kan et al.

(10) Patent No.: US 12,680,176 B2
(45) Date of Patent: Jul. 14, 2026

(54) METHOD OF OPERATING ELECTROCHEMICAL DEVICE

(71) Applicant: NGK INSULATORS, LTD., Nagoya-City (JP)

(72) Inventors: Hirofumi Kan, Nagoya (JP); Atsushi Torii, Handa (JP); Kosuke Nakagawa, Nagoya (JP); Kazuki Iida, Nagoya (JP)

(73) Assignee: NGK INSULATORS, LTD., Nagoya-City (JP)

( * ) Notice: Subject to any disclaimer, the term of this patent is extended or adjusted under 35 U.S.C. 154(b) by 73 days.

(21) Appl. No.: 18/542,898

(22) Filed: Dec. 18, 2023

(65) Prior Publication Data

US 2024/0133053 A1 Apr. 25, 2024

Related U.S. Application Data

(63) Continuation of application No. PCT/JP2023/007056, filed on Feb. 27, 2023.

(30) Foreign Application Priority Data

Mar. 4, 2022 (JP) ..... 2022-033856

(51) Int. Cl.
*C25B 15/033* (2021.01)
*C25B 1/135* (2021.01)
*C25B 11/048* (2021.01)

(52) U.S. Cl.
CPC ..... *C25B 1/135* (2021.01); *C25B 11/048* (2021.01); *C25B 15/033* (2021.01)

(58) Field of Classification Search
CPC ..... C25B 1/135; C25B 11/048; C25B 11/085; C25B 15/033; C25B 15/02; C25B 15/023; B01D 53/326; B01D 53/02; B01D 53/96; B01D 53/62; B01D 2253/20; B01D 2253/202; B01D 2257/504; B01D 2257/50; B01D 2256/22
See application file for complete search history.

(56) References Cited

U.S. PATENT DOCUMENTS

2013/0122382 A1* 5/2013 Mizuhata ..... H01M 8/0668 205/765
2017/0113182 A1 4/2017 Voskian et al.
2021/0062351 A1* 3/2021 Voskian ..... B01D 53/326

FOREIGN PATENT DOCUMENTS

JP 2018-533470 A 11/2018
WO 2021/041734 A1 3/2021

OTHER PUBLICATIONS

Sahag Voskian and T. Alan Hatton, Faradaic electro-swing reactive adsorption for CO2 capture, Energy Environ. Sci., 2019, 12, 3530-3547 (Year: 2019).*

(Continued)

*Primary Examiner* — Luan V Van
*Assistant Examiner* — Mofoluwaso S Jebutu
(74) *Attorney, Agent, or Firm* — Muncy, Geissler, Olds & Lowe, P.C.

(57) ABSTRACT

A method of operating an electrochemical device includes the steps of: applying a first adsorption voltage to a function electrode while supplying a predetermined gas to the function electrode; and switching the first adsorption voltage to a second adsorption voltage higher than the first adsorption voltage while maintaining the supply of the predetermined gas to the function electrode.

5 Claims, 8 Drawing Sheets

(56) References Cited

OTHER PUBLICATIONS

English translation of the International Preliminary Report on Patentability (Chapter I) dated Sep. 19, 2024 (Application No. PCT/JP2023/007056).
Shiqing Hu, et al., "Cathode Activation Process and $CO_2$ Electroreduction Mechanism on $LnFEO_{3-\delta}$(Ln=La, Pr and Gd) Perovskite Cathodes," *Journal of Power Sources*, vol. 485 (2021), Elsevier, Amsterdam NL, Dec. 16, 2020 (8 pages).
Extended European Search Report (Application No. 23763396.1) dated Nov. 11, 2024 (10 pages).
Sahad Voskian, et al., "Faradaic Electro-Swing Reactive Adsorption for $CO_2$ Capture," *Energy & Environmental Science*, 2019, vol. 12, pp. 3530-3547 (18 pages).
International Search Report and Written Opinion (Application No. PCT/JP2023/007056) dated Apr. 25, 2023 (8 pages).

* cited by examiner

METHOD OF OPERATING ELECTROCHEMICAL DEVICE

CROSS-REFERENCE TO RELATED APPLICATIONS

This application is a continuation under 35 U.S.C. 120 of International Application PCT/JP2023/007056 having the International Filing Date of 27 Feb. 2023 and having the benefit of the earlier filing dates of Japanese Application No. 2022-033856, filed on 4 Mar. 2022. Each of the identified applications is fully incorporated herein by reference.

BACKGROUND OF THE INVENTION

1. Field of the Invention

The present invention relates to a method of operating an electrochemical device.

2. Description of the Related Art

The development of a technology for separating and capturing a predetermined gas from a gas mixture has been continuously advanced. In particular, in recent years, it has been required that carbon dioxide ($CO_2$) emissions be reduced in order to mitigate global warming, and an attempt has been made to separate and capture carbon dioxide from the gas mixture. A Carbon dioxide Capture, Utilization and Storage (CCUS) cycle is known as a typical example of such attempt. In this connection, for the capture of carbon dioxide, for example, a chemical adsorption method, a physical adsorption method, a cryogenic separation method, a membrane separation method, and an electrochemical capturing method are known. However, currently, those technologies are each insufficient in ability to capture carbon dioxide and each require significantly large energy for the capture, and thus various issues to be considered remain for their practical use.

CITATION LIST

Patent Literature

[PTL 1] JP 2018-533470 A

SUMMARY OF THE INVENTION

A primary object of the present invention is to provide a method of operating an electrochemical device by which a predetermined gas can be separated and captured efficiently in an energy saving manner.

[1] A method of operating an electrochemical device according to one embodiment of the present invention is a method of operating an electrochemical device including a function electrode containing a first active material, and a counter electrode containing a second active material, the electrochemical device being configured to adsorb and release a predetermined gas, the method including the steps of: applying a first adsorption voltage to the function electrode while supplying the predetermined gas to the function electrode; and switching the first adsorption voltage to a second adsorption voltage higher than the first adsorption voltage while maintaining the supply of the predetermined gas to the function electrode.

[2] In the method of operating an electrochemical device according to the above-mentioned item [1], the step of switching the first adsorption voltage to the second adsorption voltage may be performed based on a current value flowing through the electrochemical device as a reference.

[3] The method of operating an electrochemical device according to the above-mentioned item [1] or [2] may further include a step of, after applying the second adsorption voltage to the function electrode, applying a release voltage having reverse polarity to the adsorption voltage to the function electrode.

[4] In the method of operating an electrochemical device according to any one of the above-mentioned items [1] to [3], a second residual adsorption amount of the gas which the function electrode is capable of further adsorbing after a step of applying the second adsorption voltage to the function electrode may be smaller than a first residual adsorption amount of the gas which the function electrode is capable of further adsorbing after the step of applying the first adsorption voltage to the function electrode.

[5] In the method of operating an electrochemical device according to any one of the above-mentioned items [1] to [4], the predetermined gas may be carbon dioxide, the first active material may include anthraquinone, the second active material may include polyvinylferrocene, the first adsorption voltage may be 1.2 V or more and less than 1.6 V, and the second adsorption voltage may be 1.6 V or more.

[6] In the method of operating an electrochemical device according to any one of the above-mentioned items [1] to [5], an average adsorption voltage to be applied to the function electrode per unit time may be 1.4 V or less.

According to the embodiment of the present invention, the method of operating an electrochemical device by which a predetermined gas can be separated and captured efficiently in an energy saving manner can be achieved.

DESCRIPTION OF THE EMBODIMENTS

Embodiments of the present invention are described below with reference to the drawings. However, the present invention is not limited to these embodiments.

A method of operating an electrochemical device according to an embodiment of the present invention includes separating and capturing a predetermined gas (e.g., carbon dioxide) from a gas mixture through use of an electrochemical device configured to adsorb and release the predetermined gas (e.g., carbon dioxide) by an electrochemical process.

A. Electrochemical Device

Figure 1:
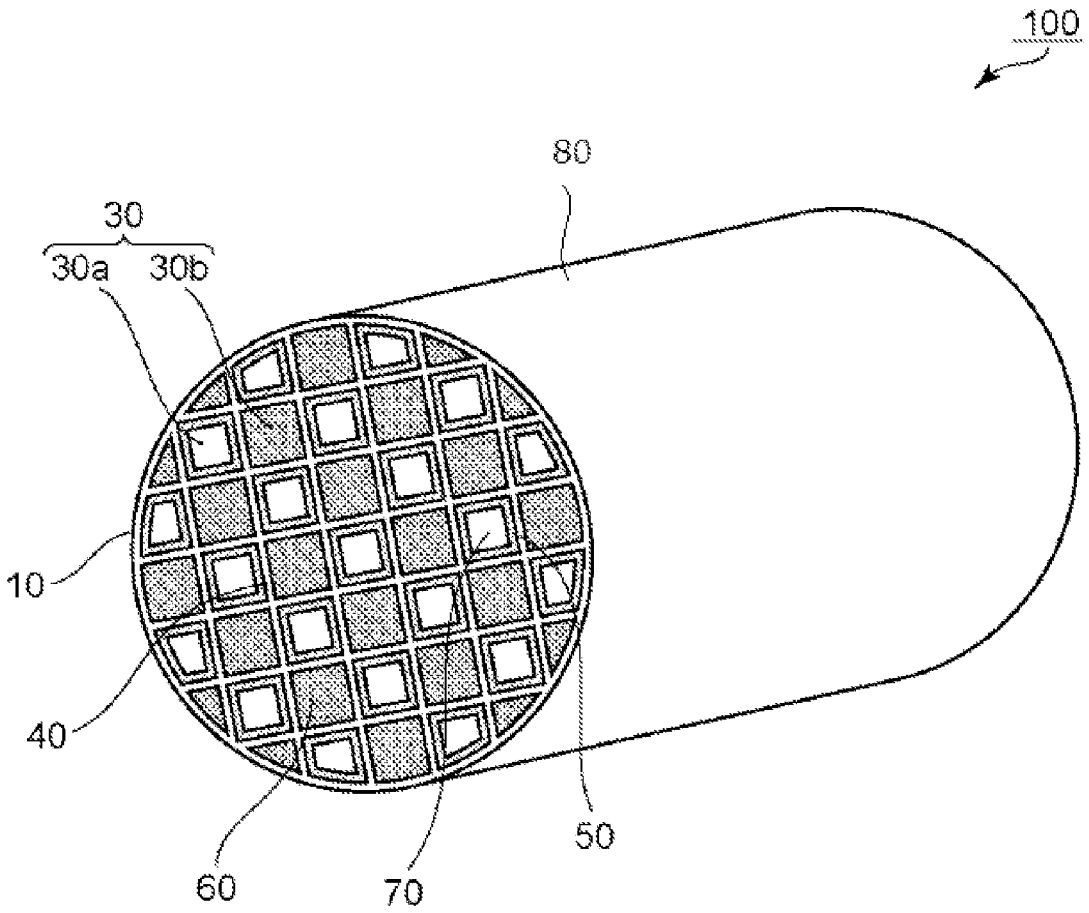
FIG. 1 is a schematic perspective view of an electrochemical device according to a method of operating an electrochemical device of one embodiment of the present invention.
Figure 2:
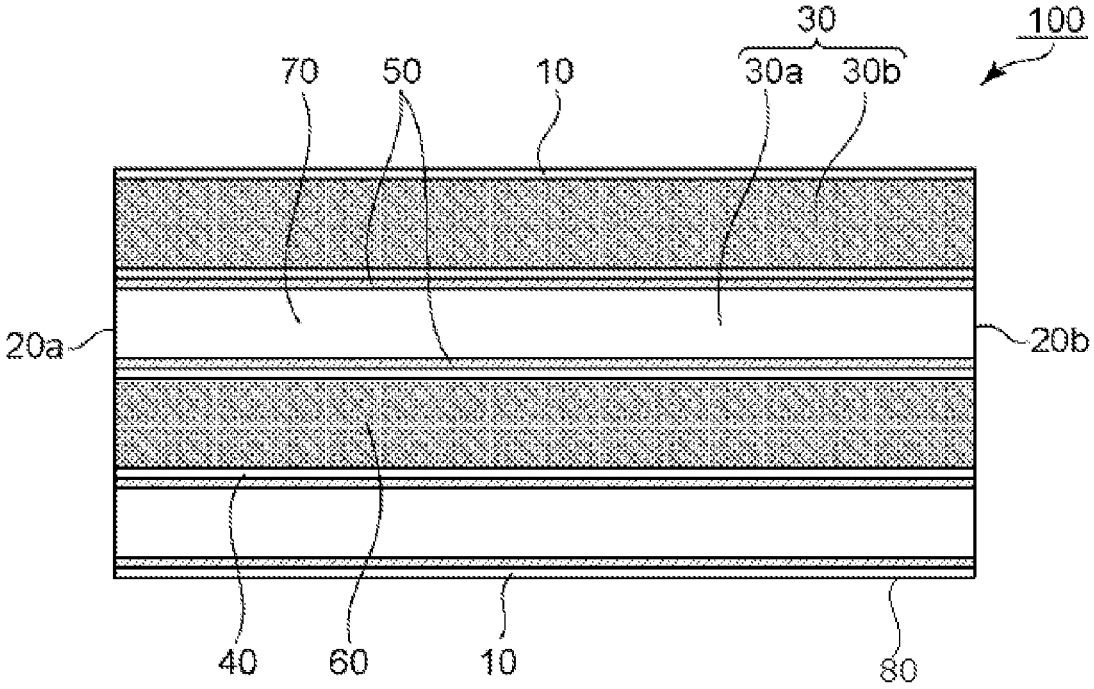
FIG. 2 is a schematic sectional view of the electrochemical device of FIG. 1 in a direction parallel to a cell extending direction.
Figure 3:
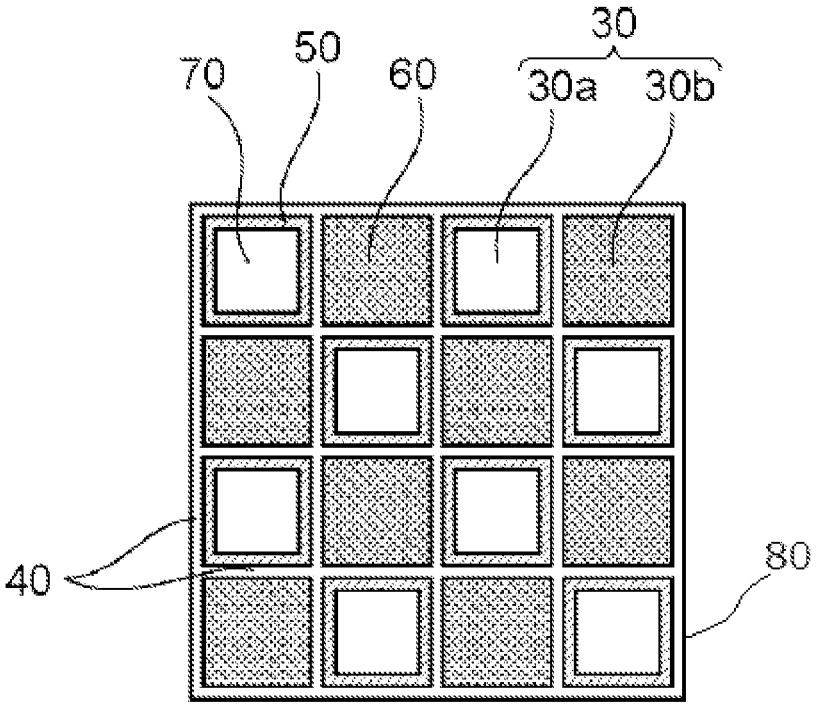
FIG. 3 is an enlarged schematic sectional view of a main portion of the electrochemical device of each of FIG. 1 and FIG. 2 in a direction perpendicular to the cell extending direction.
Figure 4:
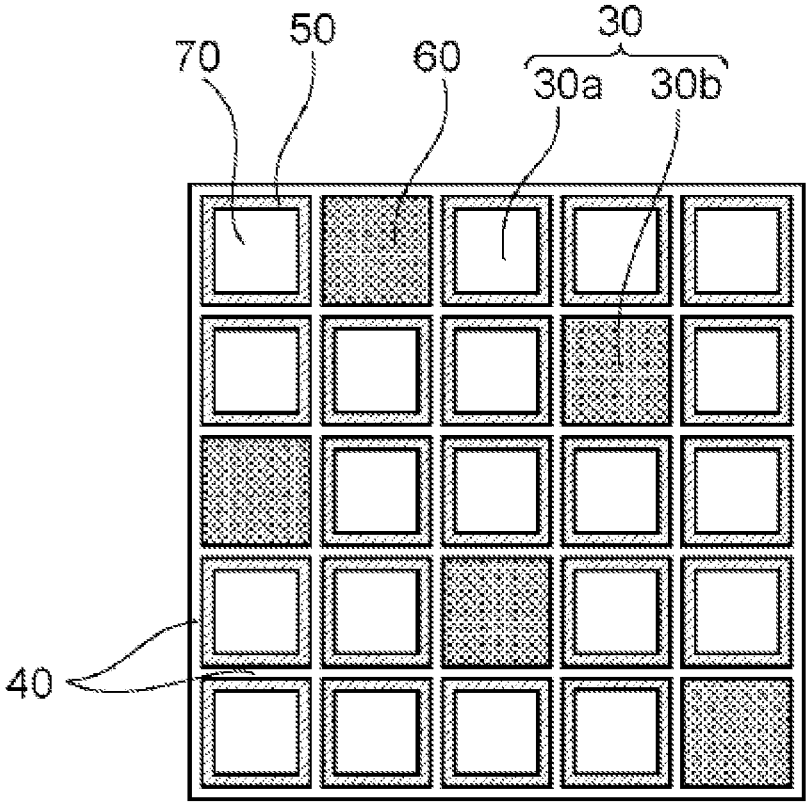
FIG. 4 is an enlarged schematic sectional view of a main portion of an electrochemical device according to another embodiment of the present invention in a direction perpendicular to a cell extending direction.
Figure 5:
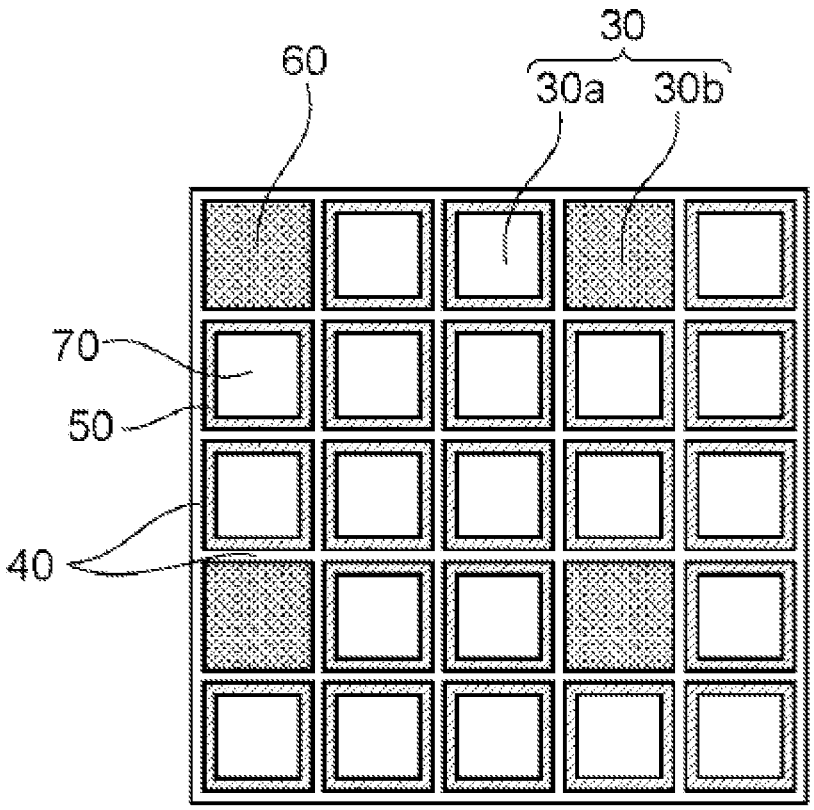
FIG. 5 is an enlarged schematic sectional view of a main portion of an electrochemical device according to still another embodiment of the present invention in a direction perpendicular to a cell extending direction.
Figure 6:
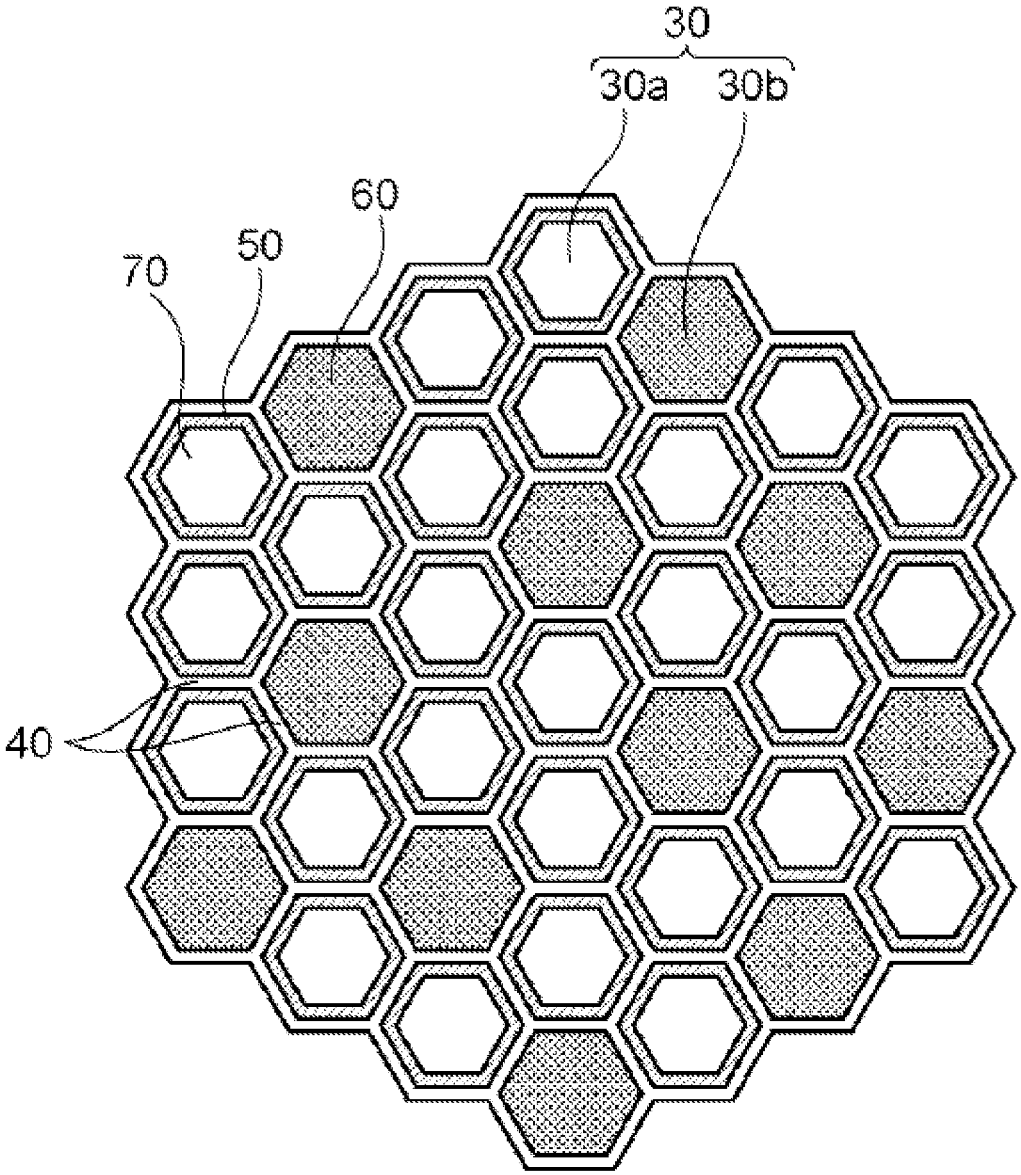
FIG. 6 is an enlarged schematic sectional view of a main portion of an electrochemical device according to still another embodiment of the present invention in a direction perpendicular to a cell extending direction.
Figure 7:
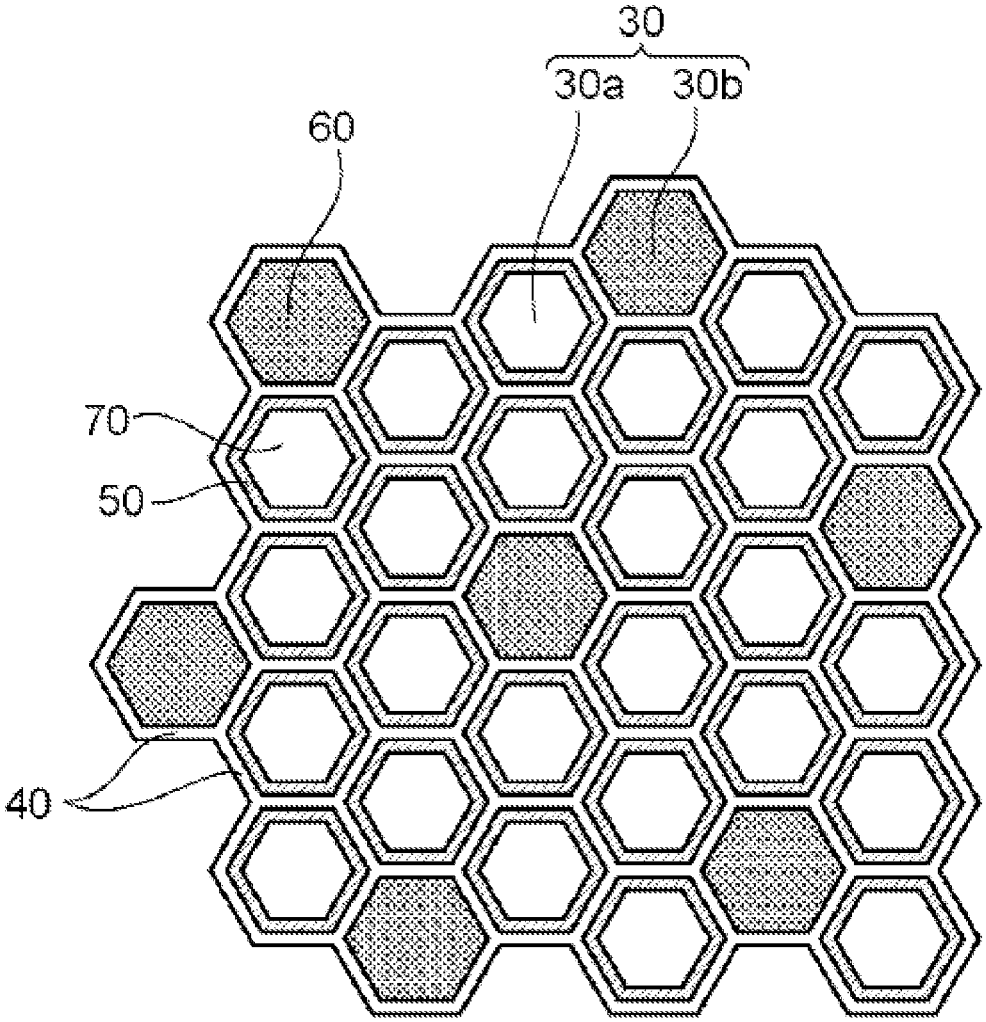
FIG. 7 is an enlarged schematic sectional view of a main portion of an electrochemical device according to still another embodiment of the present invention in a direction perpendicular to a cell extending direction.

FIG. 1 is a schematic perspective view of an electrochemical device according to a method of operating an electrochemical device of one embodiment of the present invention, FIG. 2 is a schematic sectional view of the electrochemical device of FIG. 1 in a direction parallel to a cell extending direction, and FIG. 3 is an enlarged schematic sectional view of a main portion of the electrochemical device of each of FIG. 1 and FIG. 2 in a direction perpendicular to the cell extending direction. An electrochemical device 100 of the illustrated example includes a function electrode 50 and a counter electrode 60.

A-1. Function Electrode

A function electrode contains a first active material, and is configured to capture and release a predetermined gas (e.g., carbon dioxide). A typical example of the first active material is anthraquinone. Anthraquinone can capture (trap, adsorb) and release carbon dioxide by an electrochemical reaction described below. Anthraquinone may be polyanthraquinone (that is, a polymer). Examples of the polyanthraquinone include poly(1,4-anthraquinone) represented by the following formula (I), poly(1,5-anthraquinone), poly(1,8-anthraquinone), and poly(2,6-anthraquinone). Those anthraquinones may be used alone or in combination thereof.

(I)

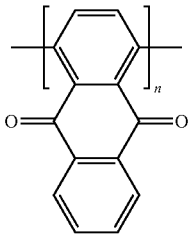

Any appropriate substance other than anthraquinone may be used as the first active material as long as the substance can capture and release (particularly, capture) the predetermined gas (e.g., carbon dioxide). Examples of such substance include tetrachlorohydroquinone (TCHQ), hydroquinone (HQ), dimethoxybenzoquinone (DMBQ), naphthoquinone (NQ), tetracyanoquinodimethane (TCNQ), dihydroxybenzoquinone (DHBQ), and polymers thereof.

The function electrode may further contain a substrate. Herein, the "substrate" refers to a component that shapes an electrode (layer) and maintains the shape thereof. Further, the substrate may support the first active material. The substrate is typically electron conductive. An example of the substrate is a carbonaceous material. Examples of the carbonaceous material include carbon nanotubes (e.g., a single-walled carbon nanotube and a multi-walled carbon nanotube), carbon black, Ketjen Black, carbon black Super P, and graphene. When such carbonaceous material is used as the substrate, electron transfer can be easily performed, and thus a redox reaction of the first active material can be satisfactorily performed. For example, when anthraquinone or polyanthraquinone is used as the first active material, the average pore diameter of the substrate is preferably from 2 nm to 50 nm, more preferably from 2 nm to 20 nm, still more preferably from 3 nm to 10 nm. When the average pore diameter is excessively small, the substrate cannot support the first active material in an inside thereof in some cases. When the average pore diameter is excessively large, the first active material escapes during the operation of the function electrode in some cases. The average pore diameter of the substrate may vary depending on the first active material. For example, when naphthoquinone is used as the first active material, the average pore diameter is preferably a size that is about ⅔ of the above-mentioned average pore diameter. The average pore diameter may be calculated, for example, by using BJH analysis in a nitrogen gas adsorption method.

The content of the first active material in the function electrode may be, for example, from 10 mass % to 70 mass %, or may be, for example, from 20 mass % to 50 mass % with respect to the total mass of the function electrode. When the content of the first active material falls within such ranges, satisfactory gas capture and release performance can be achieved.

A-2. Counter Electrode

A counter electrode can function as an electron source for the reduction of the first active material, and can also function as an electron acceptor at the time of the oxidation of the first active material. That is, the counter electrode plays a subsidiary role for satisfactory functioning of the function electrode. The counter electrode contains a second active material. Any appropriate substance may be used as the second active material as long as electron transfer can be satisfactorily performed between the substance and the function electrode. Examples of the second active material include polyvinylferrocene and poly(3-(4-fluorophenyl)) thiophene. The counter electrode is subjected to the highest potential, and is hence required to have resistance to oxidation with oxygen in the gas mixture. A carbon material may be used to provide the second active material as long as the resistance to oxidation is obtained.

The counter electrode may further contain a substrate. The substrate is as described in the section A-1 for the function electrode. In one embodiment, the second active material is dispersed in the substrate. When the second active material is dispersed in the substrate, excellent electron conductivity can be achieved in the electrode.

The counter electrode may further contain an ionic liquid. When the counter electrode contains the ionic liquid, the counter electrode can sterically function, and an increase in electron transfer capacity can be achieved. Any appropriate ionic liquid may be used as the ionic liquid depending on, for example, the purposes and the configuration of the electrochemical device. The ionic liquid may typically contain an anionic component and a cationic component. Examples of the anionic component of the ionic liquid include a halide, sulfuric acid, sulfonic acid, carbonic acid, bicarbonic acid, phosphoric acid, nitric acid, nitrous acid, acetic acid, $PF_6^-$, $BF_4^-$, triflate, nonaflate, bis(triflyl)amide, trifluoroacetic acid, heptafluorobutanoic acid, a haloaluminate, triazolide, and an amino acid derivative (e.g., proline in which a proton on a nitrogen atom is removed). Examples of the cationic component of the ionic liquid include imidazolium, pyridinium, pyrrolidinium, phosphonium, ammonium, sulfonium, triazolium, pyrazolium, piperidinium, triazolium, oxazolium, guanadinium, and a dialkylmorpholinium. The ionic liquid may be, for example, 1-butyl-3-methylimidazolium tetrafluoroborate ($[Bmim]^+[BF_4]^-$). When the kind of the gas to be separated and captured is carbon dioxide, a non-aqueous ionic liquid is preferably used because water may be electrolyzed in relation to a potential window.

The content of the second active material in the counter electrode may be, for example, from 10 mass % to 90 mass %, or may be, for example, from 30 mass % to 70 mass % with respect to the total mass of the counter electrode. When the content of the second active material falls within such ranges, the usage amount of an electrolytic solution (ionic liquid) can be reduced, and the second active material in the counter electrode can be effectively utilized.

When the counter electrode contains the ionic liquid, the content thereof may be, for example, from 10 mass % to 90 mass %, or may be, for example, from 30 mass % to 70 mass % with respect to the total mass of the counter electrode. When the content of the ionic liquid falls within such ranges, the electrolytic solution (ionic liquid) can be continuously supplied to the function electrode for a long period of time.

A-3. Support

In one embodiment of the present invention, the function electrode 50 and the counter electrode 60 are supported by a support 80. The support 80 includes: an outer peripheral wall 10; and partition walls 40 that are arranged inside the outer peripheral wall 10 and define a plurality of cells 30, 30, each extending from a first end surface 20*a* to a second end surface 20*b*.

The plurality of cells 30, 30, include a first cell 30*a* and a second cell 30*b*. The surface of the partition wall 40 that defines the first cell 30*a* has formed thereon the function electrode 50 containing the first active material. With such configuration, while sufficient strength is ensured, a contact area between the gas mixture (substantially, the gas to be separated and captured) at a predetermined flow rate and the function electrode can be significantly increased. As a result, the predetermined gas (e.g., carbon dioxide) can be separated and captured with significantly high efficiency. Further, the predetermined gas (e.g., carbon dioxide) can be separated and captured efficiently in a small-scale facility, and energy required for the separation and capture of the gas can be significantly reduced. As described above, according to one embodiment of the present invention, when a so-called honeycomb structure as described above is adopted as the basic structure of the electrochemical device, the gas can be separated and captured efficiently in an energy saving manner in a small-scale facility.

A gas flow passage 70 is formed in a center portion of a cross section of the first cell 30*a* in the direction perpendicular to the cell extending direction (i.e., a portion in which the function electrode 50 is not formed). The function electrode 50 may be formed on the entire surface of the partition wall 40 (i.e., so as to surround the gas flow passage 70) as in the illustrated example, or may be formed on part of the surface of the partition wall. In consideration of gas separation and capture efficiency, it is preferred that the function electrode 50 be formed on the entire surface of the partition wall 40.

The thickness of the function electrode 50 may be, for example, from 20 μm to 300 μm, or may be, for example, from 100 μm to 200 μm. When the thickness of the function electrode falls within such ranges, while satisfactory gas capture and release performance is maintained, a desired gas flow passage can be ensured.

The function electrode 50 may be formed, for example, by subjecting a function electrode-forming material containing the first active material, the substrate, and a binder for binding to dry application under reduced pressure on the surface of the partition wall, followed by heat treatment.

The counter electrode 60 containing the second active material is arranged inside the second cell 30*b*. The second cell 30*b* is typically filled with the counter electrode 60. When the cell 30*b* is filled with the counter electrode, the electrolytic solution (ionic liquid) can be continuously supplied to the function electrode for a long period of time.

The counter electrode 60 may be formed, for example, by arranging a counter electrode-forming material containing the second active material, the substrate, preferably the ionic liquid, and as required a solvent or a dispersion medium in the cell (typically, by filling the cell with the counter electrode-forming material).

The arrangement pattern of the first cell 30*a* and the second cell 30*b* may be appropriately set depending on the purposes as long as the effect according to the embodiment of the present invention can be obtained. In the example illustrated in each of FIG. 1 to FIG. 3, the first cell 30*a* and the second cell 30*b* are arranged alternately (i.e., in a checker pattern). With such configuration, the counter electrode can satisfactorily function, and hence an electrochemical reaction in the function electrode can be satisfactorily performed. In addition, the ratio of the second cell 30*b* in the plurality of cells 30, 30, . . . may be reduced as long as the number (ratio) of counter electrodes each capable of functioning can be ensured. That is, the ratio of the first cell 30*a* (substantially, the function electrode 50 and the gas flow passage 70) may be increased. For example, in each of examples illustrated in FIG. 4 to FIG. 7, the second cells 30*b* are arranged so as not to be adjacent to each other. In this case, the first cells 30*a* may be arranged so as to be adjacent to each other. Herein, the phrase "not to be adjacent to each other" refers to the case in which two cells share none of the sides and vertices of the partition walls that define the respective cells. With such configuration, the contact area between the gas mixture (substantially, the gas to be separated and captured) at a predetermined flow rate and the function electrode can be further increased, and as a result, gas separation and capture performance can be further improved. In this case, the first cell 30*a* may typically share the partition wall 40 with at least one second cell 30*b*. For example, the second cell 30*b* may be arranged as illustrated in each of FIG. 4 to FIG. 7.

The cells 30, 30, . . . each have any appropriate sectional shape in the direction perpendicular to the cell extending direction. In each of the examples illustrated in FIG. 1 to FIG. 5, the partition walls 40 that define cells are perpendicular to each other, to thereby define cells each having a quadrangular (square in each of the illustrated examples)

sectional shape except for a portion brought into contact with the outer peripheral wall 10. In one embodiment, the sectional shapes of the cells are the same quadrangle (e.g., square, rectangle, parallelogram, or rhombus). Other than a square, the sectional shapes of the cells may each be set to a shape, such as a circle, an ellipse, a triangle, a pentagon, a hexagon, or a higher polygon. For example, in each of the examples illustrated in FIG. 6 and FIG. 7, the sectional shapes of the cells are each a hexagon. With such configuration, the following advantages are obtained. The formation of the function electrode and the counter electrode is facilitated. Besides, a pressure loss at the time when the gas is caused to flow is small, and separation and capture performance is excellent.

A cell density in the direction perpendicular to the cell extending direction (i.e., the number of the cells 30, 30, . . . per unit area) may be appropriately set depending on the purposes. The cell density may be, for example, from 4 cells/$cm^2$ to 320 cells/$cm^2$. When the cell density falls within such range, the contact area between the gas mixture (substantially, the gas to be separated and captured) at a predetermined flow rate and the function electrode can be significantly increased. As a result, the predetermined gas (e.g., carbon dioxide) can be separated and captured with significantly high efficiency. For example, while a flat plate-shaped gas separation device in which a function electrode and a counter electrode are opposed to each other through intermediation of a separator has a mounting density of about 0.2 $m^2$/L, the electrochemical device having the above-mentioned configuration can ensure a mounting density of about 2 $m^2$/L (about 10 times). As a result, the predetermined gas (e.g., carbon dioxide) can be separated and captured efficiently in a small-scale facility, and energy required for the separation and capture of the gas can be significantly reduced. Further, when such mounting density is ensured, Direct Air Capture (DAC) can be performed.

The support 80 (the outer peripheral wall 10 and the partition wall 40) is typically formed of a porous body including an insulating ceramic. The insulating ceramic typically includes cordierite, alumina, or silicon carbide and silicon (hereinafter sometimes referred to as "silicon carbide-silicon composite material"). The ceramic includes cordierite, alumina, silicon carbide, and silicon at, for example, 90 mass % or more, or for example, 95 mass % or more, in total. With such configuration, the volume resistivities of the outer peripheral wall and the partition wall at 400° C. can be sufficiently increased, and thus a leakage current due to electron conductivity can be suppressed. Accordingly, only a desired electrochemical reaction can be satisfactorily performed over the entirety of the function electrode 50 and the counter electrode 60. The ceramic may include any substance other than the silicon carbide-silicon composite material. An example of such substance is strontium.

The silicon carbide-silicon composite material typically includes silicon carbide particles each serving as an aggregate and silicon serving as a binder for binding the silicon carbide particles. In the silicon carbide-silicon composite material, for example, a plurality of silicon carbide particles are bound by silicon so as to form pores (voids) between the silicon carbide particles. That is, the partition wall 40 and the outer peripheral wall 10 each including the silicon carbide-silicon composite material may be, for example, a porous body.

The content ratio of silicon in the silicon carbide-silicon composite material is preferably from 10 mass % to 40 mass %, more preferably from 15 mass % to 35 mass %. When the content ratio of silicon is excessively small, the strength of the outer peripheral wall and the partition wall is insufficient in some cases. When the content ratio of silicon is excessively large, the outer peripheral wall and the partition wall cannot retain their shapes at the time of firing in some cases.

The average particle diameter of the silicon carbide particles is preferably from 3 μm to 50 μm, more preferably from 3 μm to 40 μm, still more preferably from 10 μm to 35 μm. When the average particle diameter of the silicon carbide particles falls within such ranges, the volume resistivities of the outer peripheral wall and the partition wall can be set to fall within an appropriate range as described above. When the average particle diameter of the silicon carbide particles is excessively large, a forming die may be clogged with a raw material at the time of the forming of the outer peripheral wall and the partition wall. The average particle diameter of the silicon carbide particles may be measured, for example, by laser diffractometry.

The average pore diameter of the support 80 (the outer peripheral wall 10 and the partition wall 40) is preferably from 2 μm to 20 μm, more preferably from 10 μm to 20 μm. When the average pore diameter of the outer peripheral wall and the partition wall falls within such ranges, satisfactory impregnation with the ionic liquid can be achieved. When the average pore diameter is excessively large, the carbonaceous material in the counter electrode or the function electrode may flow into an inside of the partition wall, and as a result, an internal short circuit may occur. The average pore diameter may be measured, for example, with a mercury porosimeter.

The porosity of the support 80 (the outer peripheral wall 10 and the partition wall 40) is preferably from 15% to 60%, more preferably from 30% to 45%. When the porosity is excessively low, the deformation of the outer peripheral wall and the partition wall may be increased at the time of firing. When the porosity is excessively high, the strength of the outer peripheral wall and the partition wall may be insufficient. The porosity may be measured, for example, with a mercury porosimeter.

The thickness of the partition wall 40 may be appropriately set depending on the purposes. The thickness of the partition wall 40 is, for example, from 50 μm to 1.0 mm, or may be, for example, from 70 μm to 600 μm. When the thickness of the partition wall falls within such ranges, the electrochemical device can have sufficient mechanical strength, and can also have a sufficient opening area (the total area of the cells in a cross section), and thus gas separation and capture efficiency can be remarkably improved.

The density of the partition wall 40 may be appropriately set depending on the purposes. The density of the partition wall 40 may be, for example, from 0.5 g/$cm^3$ to 5.0 g/$cm^3$. When the density of the partition wall falls within such range, weight saving of the electrochemical device can be achieved, and sufficient mechanical strength thereof can also be achieved. The density may be measured, for example, by the Archimedes method.

In one embodiment of the present invention, the thickness of the outer peripheral wall 10 is larger than the thickness of the partition wall 40. With such configuration, the fracture, breakage, cracks, and the like of the outer peripheral wall due to external force can be suppressed. The thickness of the outer peripheral wall 10 is, for example, from 0.1 mm to 5 mm, or may be, for example, from 0.3 mm to 2 mm.

In one embodiment of the present invention, the voids of the partition wall 40 and the outer peripheral wall 10 are each impregnated with the ionic liquid. With such configuration, the partition wall and the outer peripheral wall (particularly, the partition wall) can each satisfactorily function as a separator between the function electrode and the counter electrode. Further, through the impregnation with the ionic liquid, the electron conductivity is reduced, and only a desired electrochemical reaction can be efficiently performed. In one embodiment, the ionic liquid in the function electrode is the same as the ionic liquid in each of the outer peripheral wall and the partition wall (particularly, the partition wall). With such configuration, the production of the electrochemical device is simplified and facilitated, and adverse effects on the electrochemical reaction of the function electrode can be prevented.

The shape of the electrochemical device may be appropriately designed depending on the purposes. While the electrochemical device 100 of the illustrated example has a cylindrical shape (its sectional shape in the direction perpendicular to the cell extending direction is a circle), the electrochemical device may have a columnar shape whose sectional shape is, for example, an ellipse or a polygon (e.g., a quadrangle, a pentagon, a hexagon, or an octagon). The length of the electrochemical device may be appropriately set depending on the purposes. The length of the electrochemical device may be, for example, from 5 mm to 500 mm. The diameter of the electrochemical device may be appropriately set depending on the purposes. The diameter of the electrochemical device may be, for example, from 20 mm to 500 mm. When the sectional shape of the electrochemical device is not a circle, the diameter of the maximum inscribed circle that is inscribed in the sectional shape (e.g., a polygon) of the electrochemical device may be used as the diameter of the electrochemical device. The aspect ratio of the electrochemical device (diameter:length) is, for example, 1:12 or less, or for example, 1:5 or less, or for example, 1:1 or less. When the aspect ratio falls within such ranges, current collection resistance can be set to fall within an appropriate range.

In the foregoing, the configuration of the electrochemical device 100 has been described by conveniently illustrating one electrochemical device 100. In one embodiment of the present invention, however, a plurality of electrochemical devices may be used. When the plurality of electrochemical devices are used, the plurality of electrochemical devices may be arranged next to each other in the cell extending direction so that gas flow passages thereof communicate to each other. In addition, in one embodiment of the present invention, an array of the plurality of electrochemical devices arranged in the cell extending direction may be arranged in a plurality of numbers in the direction perpendicular to the cell extending direction.

While, in the above-mentioned one embodiment of the present invention, the electrochemical device 100 includes the support 80 including the plurality of cells 30, and the support 80 supports the function electrode 50 and the counter electrode 60, the electrochemical device is not limited thereto. For example, the electrochemical device may include a plurality of flat plate-shaped gas separation devices arranged in a direction parallel to the thickness direction of each of the gas separation devices so as to be spaced apart from each other, the gas separation devices each including the function electrode and the counter electrode opposed to each other through intermediation of a separator. An example of such electrochemical device is an electrochemical cell described in JP 2018-533470 A.

A-4. Electrochemical Reaction

The outline of the operation of the electrochemical device 100 is described. For example, a case in which the gas to be separated and captured is carbon dioxide, the first active material of the function electrode 50 includes anthraquinone, and the second active material of the counter electrode 60 includes polyvinylferrocene is described. Anthraquinone of the function electrode 50 can be reduced when a positive voltage is applied thereto as an adsorption voltage in a charge mode (the function electrode is a negative electrode).

In this case, when the gas mixture including carbon dioxide is caused to flow through the gas flow passage 70 of the electrochemical device, the following reaction (1) occurs between anthraquinone of the function electrode 50 in a reduced state and carbon dioxide, and carbon dioxide is trapped by anthraquinone. In this manner, carbon dioxide can be captured.

(1)

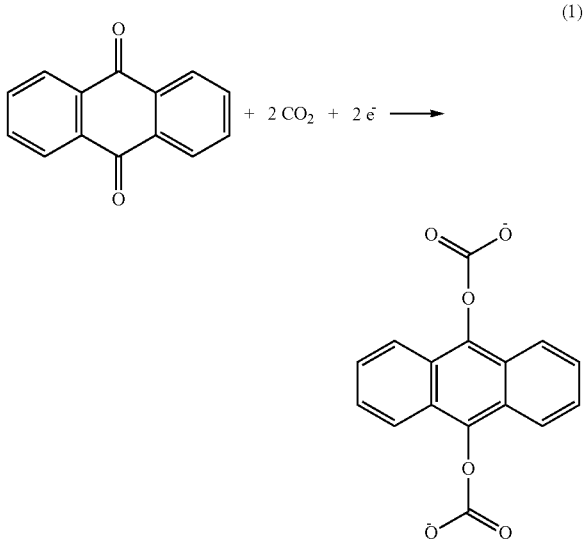

At this time, polyvinylferrocene of the counter electrode 60 can be oxidized. That is, polyvinylferrocene can function as an electron source for the reduction of anthraquinone in the charge mode.

In addition, anthraquinone of the function electrode 50 can be oxidized when a negative voltage is applied thereto as a release voltage having reverse polarity to the adsorption voltage in a discharge mode (the function electrode is a positive electrode).

In this case, when anthraquinone having trapped carbon dioxide is oxidized in the function electrode 50, the following reaction (2) occurs, and carbon dioxide having been trapped by anthraquinone is unbound from anthraquinone. In this manner, carbon dioxide can be released from the function electrode 50 to the gas flow passage 70.

(2)

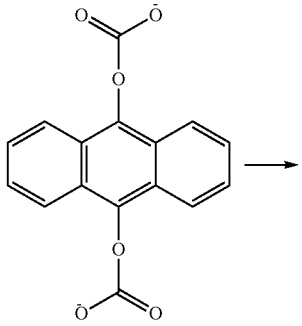

-continued

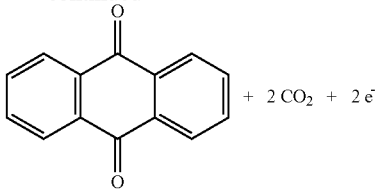

At this time, polyvinylferrocene of the counter electrode 60 can be reduced. That is, polyvinylferrocene can function as an electron acceptor at the time of the oxidation of anthraquinone in the discharge mode.

As described above, through switching of the polarity of the function electrode (and inevitably the counter electrode), the electrochemical device (substantially, the function electrode) can capture (trap, adsorb) and release carbon dioxide. In particular, through utilization of anthraquinone in a reduced state in the charge mode, carbon dioxide can be separated and captured (trapped) from the gas mixture. As described above, the electrochemical device 100 can capture carbon dioxide.

The method of operating an electrochemical device is described below.

B. Method of Operating Electrochemical Device

A method of operating an electrochemical device according to one embodiment of the present invention includes the steps of: applying a first adsorption voltage to a function electrode while supplying a predetermined gas (e.g., carbon dioxide) to the function electrode; and switching the first adsorption voltage to a second adsorption voltage higher than the first adsorption voltage while maintaining the supply of the predetermined gas (e.g., carbon dioxide) to the function electrode. The step of applying the first adsorption voltage to the function electrode and the step of switching the first adsorption voltage to the second adsorption voltage serve as a gas adsorption step of causing the predetermined gas (e.g., carbon dioxide) to be adsorbed to the function electrode. According to such method, while a reduction in average adsorption voltage to be applied to the function electrode per unit time is achieved, the predetermined gas (e.g., carbon dioxide) can be separated and captured with significantly high efficiency. For example, an exhaust gas from a plant or a thermal power station includes about 10% of carbon dioxide. In view of the foregoing, the concentration of carbon dioxide in the gas mixture having the same configuration as such exhaust gas can be reduced to 0.1% or less by the method of operating an electrochemical device according to one embodiment of the present invention. As a result, degradation of the electrochemical device can be suppressed, and while an increase in lifetime of the electrochemical device is achieved, energy required for the separation and capture of the predetermined gas (e.g., carbon dioxide) can be significantly reduced.

Figure 8:
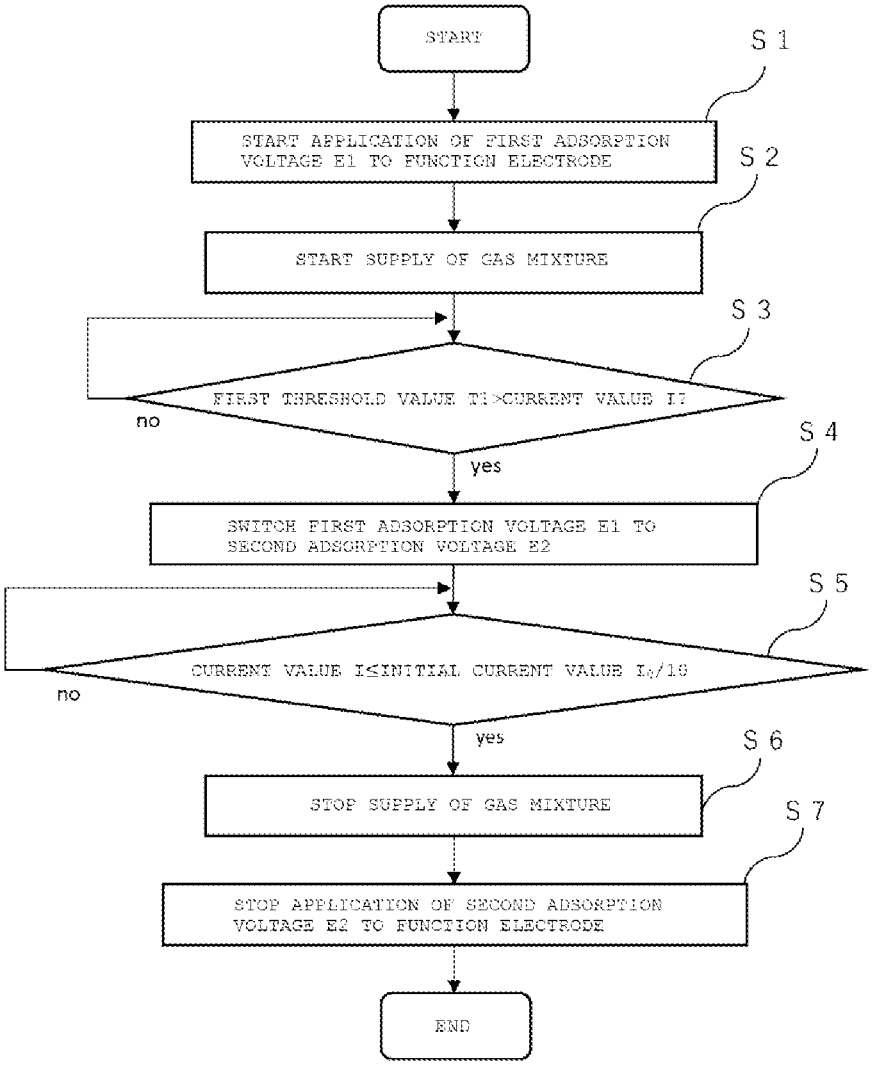
FIG. 8 is a process flow chart for illustrating the method of operating an electrochemical device of one embodiment of the present invention.

As described above, according to one embodiment of the present invention, a relatively low adsorption voltage is applied to the function electrode in a former stage (initial stage) of the gas adsorption step, and a relatively high adsorption voltage is applied to the function electrode in a latter stage (final stage) of the gas adsorption step. The gas can be thus separated and captured efficiently in an energy saving manner. FIG. 8 is a process flow chart for illustrating the method of operating an electrochemical device according to the embodiment of the present invention. The steps are described below with reference to FIG. 8.

First, while the predetermined gas (e.g., carbon dioxide) is supplied to the function electrode 50, the first adsorption voltage is applied to the function electrode 50. In one embodiment of the present invention, while the gas mixture including carbon dioxide is supplied to the function electrode 50, a first adsorption voltage E1 is applied to the function electrode 50. More specifically, after the application of the first adsorption voltage E1 to the function electrode 50 is started (S1), the supply of the gas mixture to the function electrode 50 is started (S2) by causing the gas mixture including carbon dioxide to flow through the gas flow passage 70. The first adsorption voltage E1 is applied to the function electrode 50 from, for example, a constant voltage source.

In one embodiment of the present invention, the first adsorption voltage E1 is, for example, from 1.0 V to 1.6 V. When the first active material includes anthraquinone, the first adsorption voltage E1 is preferably from 1.2 V to 1.6 V, more preferably from 1.2 V to 1.4 V, particularly preferably from 1.2 V to 1.3 V.

When the first adsorption voltage E1 falls within such ranges, a reduction in average adsorption voltage to be applied to the function electrode per unit time is achieved, and degradation of the electrochemical device can be suppressed. Concurrently, the predetermined gas can be stably adsorbed to the first active material in the former stage of the adsorption step for the predetermined gas. For example, in the case where the predetermined gas is carbon dioxide and the first active material of the function electrode includes anthraquinone, when the first adsorption voltage E1 is applied to the function electrode, out of two carbonyl groups in anthraquinone, one carbonyl group is made into an anion and the other carbonyl group is made into a radical, and the carbonyl group having been made into an anion can react with carbon dioxide to capture carbon dioxide, as shown in the following formula (1-1).

(1-1)

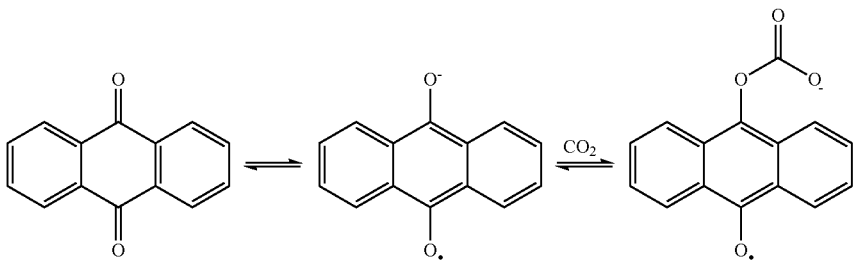

As described above, when the first adsorption voltage is applied to the function electrode, one molecule of anthraquinone can trap one molecule of carbon dioxide.

Next, in one embodiment of the present invention, the first adsorption voltage is switched to the second adsorption voltage based on a current value I flowing through the electrochemical device 100 as a reference. According to such method, while the adsorption amount of the predetermined gas (e.g., carbon dioxide) to the function electrode 50 is checked based on the current value I flowing through the electrochemical device 100, the first adsorption voltage can be switched to the second adsorption voltage at an appropriate timing. As a result, energy required for the separation and capture of the predetermined gas (e.g., carbon dioxide) can be still further reduced.

Specifically, after the application of the first adsorption voltage E1 to the function electrode 50 is started, the current value I flowing through the electrochemical device 100 is monitored. As the adsorption of the predetermined gas to the function electrode 50 proceeds, the resistance of the function electrode 50 may be increased more. With this, when the application of the constant first adsorption voltage E1 is continued, the current value I flowing through the electrochemical device 100 may be gradually reduced.

After that, until the current value I flowing through the electrochemical device 100 becomes less than a preset first threshold value T1, the application of the first adsorption voltage E1 to the function electrode 50 is continued (no in S3).

When the current value I flowing through the electrochemical device 100 becomes less than the preset first threshold value T1 (Yes in S3), while the supply of the gas mixture to the function electrode 50 is maintained, the first adsorption voltage is switched to the second adsorption voltage (S4).

The first threshold value T1 may be preset based on a first residual adsorption amount. For example, the current value I is actually measured (or calculated through simulation) when the residual adsorption amount of the function electrode 50 at the adsorption voltage E1 reaches 30%, and the resultant current value I may be used as the first threshold value T1.

The first residual adsorption amount is a target value in the step (first application step) of applying the first adsorption voltage to the function electrode, and means an adsorption ability of the function electrode to further adsorb the gas after the first application step. The first residual adsorption amount is determined by subtracting the adsorption capacity (first adsorption capacity) of the function electrode to be used in the first application step from the initial adsorption capacity (maximum adsorption capacity) of the function electrode.

When the predetermined gas is carbon dioxide, the initial adsorption capacity (maximum adsorption capacity) of the function electrode is defined as follows: while the gas mixture including 5 vol % to 20 vol % of carbon dioxide (a residual gas is $N_2$ balanced) is supplied to the function electrode, 2.0 V (upper limit voltage) is applied to the function electrode, and when a current measured 1 minute after the application of the voltage is defined as (i_0), a coulomb amount (the unit thereof is coulomb C, or may be ampere hour Ah) used until a current is reduced to 1/100 of the (i_0) is defined as the initial adsorption capacity.

In the case where the predetermined gas is carbon dioxide, when a coulomb amount used for adsorbing carbon dioxide in the first application step after the completion of desorption treatment of carbon dioxide is defined as (i_1), the first residual adsorption amount is defined as (i_0−i_1). When the first residual adsorption amount is a minus value due to a measurement error, the residual amount is defined as zero.

In addition, the reference for the switching from the first adsorption voltage E1 to the second adsorption voltage E2 is not limited to the current value flowing through the electrochemical device. The reference for the switching from the first adsorption voltage E1 to the second adsorption voltage E2 may be, for example, an application time period of the first adsorption voltage E1.

In one embodiment of the present invention, the second adsorption voltage E2 is, for example, from 1.4 V to 2.0 V. When the first active material includes anthraquinone, the second adsorption voltage E2 is preferably from 1.6 V to 2.0 V, more preferably from 1.8 V to 2.0 V. The upper limit value of the second adsorption voltage E2 is not particularly limited, and may be set to be higher than 2.0 V depending on a potential window for the decomposition of the electrolytic solution or the ionic liquid to be used.

When the second adsorption voltage E2 falls within such ranges, the predetermined gas can be sufficiently adsorbed to the first active material in the latter stage of the adsorption step for the predetermined gas. For example, in the case where the predetermined gas is carbon dioxide and the first active material of the function electrode includes anthraquinone, when the second adsorption voltage E2 is applied to the function electrode, the carbonyl group having been made into a radical in the above-mentioned formula (1-1) accepts an electron to be made into an anion, and can then react with carbon dioxide to trap carbon dioxide, as shown in the following formula (1-2).

(1-2)

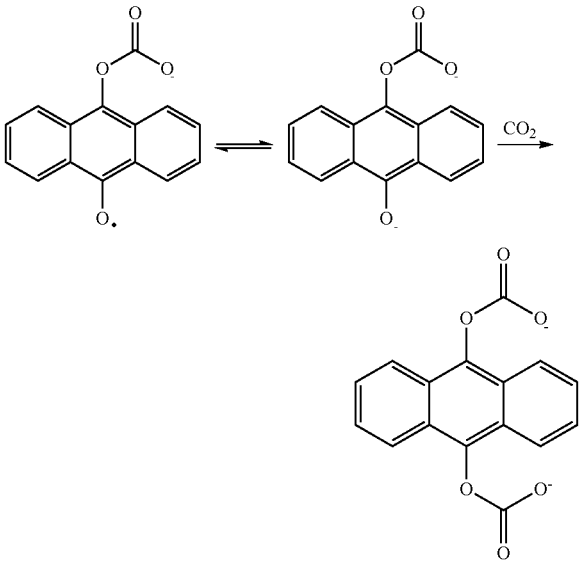

As described above, when the second adsorption voltage is applied to the function electrode, one molecule of anthraquinone can further trap one molecule of carbon dioxide.

After that, while the supply of the gas mixture to the function electrode 50 is maintained, the application of the second adsorption voltage E2 to the function electrode 50 is continued until the current value I becomes 1/10 or less of a current value (initial current value $I_0$) measured 1 minute after the switching to the second adsorption voltage E2 or until a second residual adsorption amount becomes less than 10% (no in S5). In FIG. 8, an embodiment in which the application of the second adsorption voltage E2 is continued until the current value I becomes 1/10 or less of the initial current value $I_0$ is conveniently illustrated.

In one embodiment of the present invention, the second residual adsorption amount is smaller than the above-mentioned first residual adsorption amount.

The second residual adsorption amount means an adsorption ability of the function electrode to further adsorb the gas after the step (second application step) of switching the first adsorption voltage to the second adsorption voltage, and applying the second adsorption voltage to the function electrode. The second residual adsorption amount is determined by subtracting the adsorption capacity (second adsorption capacity) of the function electrode to be used in the first application step and the second application step from the above-mentioned initial adsorption capacity (maximum adsorption capacity).

In the case where the predetermined gas is carbon dioxide, when the total of coulomb amounts used for adsorbing carbon dioxide in the first application step and the second application step after the completion of desorption treatment of carbon dioxide is defined as (i_1), the second residual adsorption amount is defined as (i_0−i_1). When the second residual adsorption amount is a minus value due to a measurement error, the residual amount is defined as zero.

When the current value I becomes 1/10 or less of the initial current value $I_0$ or when the second residual adsorption amount becomes less than 10% (Yes in S5), the supply of the gas mixture to the function electrode 50 is stopped (S6), and the application of the second adsorption voltage E2 to the function electrode 50 is then stopped (S7).

The gas adsorption step is thus completed.

The application time period of the second adsorption voltage E2 is preferably equal to or shorter than the application time period of the first adsorption voltage E1. In one embodiment of the present invention, the ratio of the application time period of the second adsorption voltage E2 is, for example, from 10% to 50%, preferably from 20% to 30% with respect to the total of the application time period of the first adsorption voltage E1 and the application time period of the second adsorption voltage E2.

In one embodiment of the present invention, the average adsorption voltage per unit time in the gas adsorption step is preferably 1.5 V or less, more preferably 1.4 V or less. The average adsorption voltage per unit time in the gas adsorption step may be calculated by the following equation.

Average adsorption voltage per unit time in gas adsorption step=((first adsorption voltage $E1$×application time period of first adsorption voltage $E1$)+(second adsorption voltage $E2$×application time period of second adsorption voltage $E2$))/(total of application time period of first adsorption voltage $E1$ and application time period of second adsorption voltage $E2$)

In addition, the method of operating an electrochemical device according to one embodiment of the present invention further includes a gas release step of, after applying the second adsorption voltage E2 to the function electrode 50, applying a release voltage having reverse polarity to the adsorption voltage to the function electrode 50. In other words, the method of operating an electrochemical device according to one embodiment of the present invention may include a gas release step after the completion of the gas adsorption step.

In the gas release step, the polarity of the function electrode 50 (and inevitably the counter electrode 60) is switched, and a negative voltage is applied to the function electrode 50 as a release voltage. As a result, the predetermined gas (e.g., carbon dioxide) having been trapped by the function electrode 50 can be released to the gas flow passage 70. The predetermined gas (e.g., carbon dioxide) having been released is captured to be used for various applications (e.g., a raw material for a methanation reaction).

The method of operating an electrochemical device according to the embodiment of the present invention can be suitably used for the separation and capture of the predetermined gas from the gas mixture, and can be particularly suitably used for a Carbon dioxide Capture, Utilization and Storage (CCUS) cycle.

What is claimed is:

1. A method of operating an electrochemical device including a function electrode containing a first active material, and a counter electrode containing a second active material, the electrochemical device being configured to adsorb and release a predetermined gas, the method comprising the steps of:

applying a first adsorption voltage to the function electrode before supplying the predetermined gas to the function electrode;

supplying the predetermined gas to the function electrode after applying the first adsorption voltage to the function electrode; and switching the first adsorption voltage to a second adsorption voltage higher than the first adsorption voltage while maintaining the supply of the predetermined gas to the function electrode, wherein the step of switching the first adsorption voltage to the second adsorption voltage is performed based on a current value flowing through the electrochemical device as a reference, wherein the first adsorption voltage is switched to the second adsorption voltage when the current value flowing through the electrochemical device becomes less than a first threshold value, and wherein the first threshold value is a current value when the residual adsorption amount of the function electrode at the adsorption voltage reaches 30%.

2. The method of operating an electrochemical device according to claim 1, further comprising a step of, after applying the second adsorption voltage to the function electrode, applying a release voltage having reverse polarity to the adsorption voltage to the function electrode.

3. The method of operating an electrochemical device according to claim 1, wherein a second residual adsorption amount of the gas which the function electrode is capable of further adsorbing after a step of applying the second adsorption voltage to the function electrode is smaller than a first residual adsorption amount of the gas which the function electrode is capable of further adsorbing after the step of applying the first adsorption voltage to the function electrode.

4. The method of operating an electrochemical device according to claim 1, wherein the predetermined gas is carbon dioxide, wherein the first active material includes anthraquinone, wherein the second active material includes polyvinylferrocene, wherein the first adsorption voltage is 1.2 V or more and less than 1.6 V, and wherein the second adsorption voltage is 1.6 V or more.

5. The method of operating an electrochemical device according to claim 4, wherein an average adsorption voltage to be applied to the function electrode per unit time is 1.4 V or less.

* * * * *